US011359527B2

(12) United States Patent
Van Trigt et al.

(10) Patent No.: US 11,359,527 B2
(45) Date of Patent: Jun. 14, 2022

(54) METHOD AND SYSTEM FOR CONTROL OF AN ACTIVATION OF AT LEAST ONE LIQUID SENSITIVE SENSOR

(71) Applicant: Scania CV AB, Södertälje (SE)

(72) Inventors: Robin Van Trigt, Åkers Styckebruk (SE); Gilfredo Remon, Stockholm (SE)

(73) Assignee: Scania CV AB, Södertälje (SE)

( * ) Notice: Subject to any disclaimer, the term of this patent is extended or adjusted under 35 U.S.C. 154(b) by 0 days.

(21) Appl. No.: 17/048,129

(22) PCT Filed: Apr. 18, 2019

(86) PCT No.: PCT/SE2019/050366
§ 371 (c)(1),
(2) Date: Oct. 16, 2020

(87) PCT Pub. No.: WO2019/209163
PCT Pub. Date: Oct. 31, 2019

(65) Prior Publication Data

US 2021/0172356 A1 Jun. 10, 2021

(30) Foreign Application Priority Data

Apr. 24, 2018 (SE) ..... 1850483-7

(51) Int. Cl.
*F01N 3/00* (2006.01)
*F01N 11/00* (2006.01)

(52) U.S. Cl.
CPC ..... *F01N 3/005* (2013.01); *F01N 11/002* (2013.01); *F01N 11/007* (2013.01);
(Continued)

(58) Field of Classification Search
CPC ..... F01N 3/005; F01N 11/002; F01N 11/007; F01N 2560/05; F01N 2560/06; F01N 2560/20
See application file for complete search history.

(56) References Cited

U.S. PATENT DOCUMENTS 5,590,521 A * 1/1997 Schnaibel ..... F02D 41/28 60/274
9,377,425 B2 * 6/2016 Di Miro ..... G01N 15/0606
(Continued)

FOREIGN PATENT DOCUMENTS

EP 2781893 A1 * 9/2014 ..... F01N 3/005
EP 2781893 A1 9/2014
(Continued)

OTHER PUBLICATIONS

Scania CV AB, International Application No. PCT/SE2019/050366, International Search Report, dated May 27, 2019.
Scania CV AB, International Application No. PCT/SE2019/050366, Written Opinion, dated May 27, 2019.
Scania CV AB, Swedish Application No. 1850483-7, Office Action, dated Oct. 16, 2018.
(Continued)

*Primary Examiner* — Matthew T Largi
(74) *Attorney, Agent, or Firm* — Moore & Van Allen PLLC; W. Kevin Ransom

(57) ABSTRACT

Disclosed is a method for control of an activation of a fluid sensitive sensor of an exhaust treatment system arranged for treating an exhaust stream, which includes: determining an exhaust temperature and an exhaust mass flow for the exhaust stream; determining if there is liquid fluid present in the exhaust stream at the fluid sensitive sensor, respectively, based on: 1) an elimination time function, wherein the elimination time function is based on the determined exhaust temperature and the determined exhaust mass flow; and 2) a corresponding lengths of a time period needed to eliminate a predetermined amount of liquid fluid from the exhaust stream; and controlling an activation of said fluid sensitive sensor based on the determination of if there is liquid fluid present in the exhaust treatment system at the fluid sensitive sensor.

15 Claims, 5 Drawing Sheets

(52) U.S. Cl.
CPC ..... *F01N 2560/05* (2013.01); *F01N 2560/06* (2013.01); *F01N 2560/20* (2013.01)

(56) References Cited

U.S. PATENT DOCUMENTS

| | | | | |
|---|---|---|---|---|
| 10,001,043 | B2 * | 6/2018 | Kamp | F02D 41/1494 |
| 2007/0204840 | A1 * | 9/2007 | Abe | F02D 41/1494 123/697 |
| 2007/0271904 | A1 * | 11/2007 | Shouda | F02D 37/02 60/284 |
| 2010/0300068 | A1 * | 12/2010 | Enomoto | F02D 41/1494 60/273 |
| 2013/0024088 | A1 * | 1/2013 | Suzuki | F02D 41/1494 701/102 |
| 2021/0025312 | A1 * | 1/2021 | Axe | F01N 13/008 |

FOREIGN PATENT DOCUMENTS

| | | | |
|---|---|---|---|
| JP | 2003049700 | A | 2/2003 |
| JP | 2010174657 | A | 8/2010 |
| KR | 101361351 | B1 | 2/2014 |
| WO | 2009112947 | A2 | 9/2009 |
| WO | 2014080846 | A1 | 5/2014 |

OTHER PUBLICATIONS

Scania CV AB, International Application No. PCT/SE2019/050366, International Preliminary Report on Patentability, dated Oct. 27, 2020.

Scania CV AB, European Patent Application No. 19792557.1, Extended European Search Report, dated Dec. 17, 2021.

* cited by examiner

METHOD AND SYSTEM FOR CONTROL OF AN ACTIVATION OF AT LEAST ONE LIQUID SENSITIVE SENSOR

CROSS-REFERENCE TO RELATED APPLICATIONS

This application is a National Stage Application (filed under 35 § U.S.C. 371) of PCT/SE2019/050366, filed Apr. 18, 2019 of the same title, which, in turn claims priority to Swedish Application No. 1850483-7 filed Apr. 24, 2018 of the same title; the contents of each of which are hereby incorporated by reference.

FIELD OF THE INVENTION

The present invention relates to a method for control of an activation of at least one fluid sensitive sensor. The present invention also relates to a system arranged for control of an activation of at least one fluid sensitive sensor. The invention also relates to a computer program and a computer-readable medium, which implement the method according to the invention.

BACKGROUND OF THE INVENTION

The following background description constitutes a description of the background to the present invention, and thus need not necessarily constitute prior art.

In connection with increased government interests concerning pollution and air quality, primarily in urban areas, emission standards and regulations regarding emissions from combustion engines have been drafted in many jurisdictions. Vehicles of today are therefore commonly equipped with exhaust treatment systems arranged for treating exhaust streams from their engines. Generally, in more or less all applications using combustion engines, e.g. in vessels and/or planes, the produced exhaust streams are purified by usage of an exhaust treatment system. In this document, the invention will be described mainly for its application in vehicles. However, the invention may be used in substantially all applications where combustion engines are used, for example in vessels such as ships or aeroplanes/helicopters, wherein regulations and standards for such applications limit emissions from the combustion engines.

Exhaust treatment systems often include one or more sensors, such as e.g. at least one nitrogen oxides $NO_x$ sensor, at least one air fuel ratio A sensor, at least one oxygen $O_2$ sensor, at least one mass flow $\dot{M}$ sensor and/or at least one particle matter PM sensor. Some of these sensors may be self-heating sensors, which are heated up to a predetermined operation temperature before being activated as sensor, i.e. before the sensor provides a sensor signal.

The one or more sensors of the exhaust treatment system may be used for controlling the exhaust treatment system, for example for determining an amount of reducing agent to be injected into the exhaust stream, for controlling a temperature of one or more components of the exhaust treatment system, for supervision of the efficiency of the exhaust treatment and/or for supervision of the tailpipe emissions leaving the vehicle. Basically, the exhaust treatment system may be controlled such that the fuel consumption is minimized at the same time as the emissions are minimized, and this control is based on sensor signals provided by the sensors. The one or more sensors of the exhaust treatment system may be used for controlling the other vehicle systems/components, such as e.g. the combustion engine.

Many of these sensors are intolerant to liquid fluid in the exhaust stream. More specifically, the sensors are susceptible/intolerant to abrupt temperature variations, which may be caused by liquid fluid in the exhaust stream. For example, water may be produced as a by-product at the combustion in the engine, and may thus be present in the exhaust stream in vaporized and/or liquid form when it passes through one or more components of the exhaust treatment system. Water will in this document generally be used as an example of a fluid possibly being present in the exhaust stream, in gaseous/vaporized state and/or in liquid state. However, the herein described invention and its embodiments may be used for handling essentially any fluid initially being present in the exhaust treatment system, i.e. being present before the engine is started. The exhaust treatment system includes a number of components through which the exhaust stream passes, and sometimes changes its direction, whereby vaporized fluids, e.g. water, may condense into liquid fluids, e.g. liquid water. Also, vaporized fluids, e.g. vaporized water, may condense in connection with cold starts of the engine. Liquid fluids, e.g. liquid water, may also enter into the exhaust treatment system, and thus into the exhaust stream, from the outside, e.g. due to rain and/or road splashes.

Liquid water, as an example, has well known maximal temperatures for given conditions, e.g. for a given pressure and/or a given purity, since water at higher temperatures, i.e. water above such maximal temperatures, is known to be in the form of vapor. At sea level, for example, liquid water of a normal purity may maximally reach approximately 100° C. before it vaporizes. The exhaust stream has much higher temperatures than the temperature of liquid water at normal operation points for the exhaust treatment system. The combustion in the engine generates heat, which is transferred to the exhaust stream. Also, many of the components in the exhaust treatment system need relatively high temperatures in order to efficiently purify the exhaust stream. Therefore, the exhaust steam often has a relatively high temperature when passing through the exhaust treatment system.

Also, for some fluid/water sensitive sensors, such as self-heating sensors, the temperature of the sensors is increased by heating the sensors to a temperature for example in the interval of 700-900° C., e.g. 850° C., which is needed in order to activate the diffusion needed for the sensors to provide a reliable sensor value. Thus, if liquid water in the exhaust stream hits the sensors, an abrupt temperature drop from e.g. 850° C. to below 100° C. will occur. The sensors may hereby break, e.g. by cracking, due to this steep temperature gradient.

SUMMARY OF THE INVENTION

In this document, the principles of the invention is often described in relation to nitrogen oxides $NO_x$ sensors. The invention is, however, applicable for essentially any fluid sensitive sensor, as mentioned above.

As mentioned above, many sensors, e.g. $NO_x$-sensors, are intolerant/susceptible to splashes of liquid fluid in the sampling gas. Liquid fluid, e.g. liquid water, is, however, commonly present in the exhaust stream passing through an exhaust system. Therefore, in conventional solutions, the sensor has been activated when all liquid fluid is believed to have been eliminated from the exhaust treatment system, i.e. eliminated from the exhaust gas stream passing through the exhaust treatment system.

After the engine is started, the exhaust gas starts to warm up the system to above the dew point temperature, and the liquid fluid in the system therefore starts to evaporate. According to conventional solutions, startup strategies are often used, which are based on only the time passed and on the temperature of the exhaust stream when trying to guess if all fluid has evaporated. This is a very imprecise/inexact way to determine if there is any liquid fluid left in the exhaust stream, which may lead to inaccurate assumptions. Therefore, when the conventional solutions are used, there is a risk that the sensors are activated too early, which could possibly lead to that they are hit by liquid fluid still being present in the exhaust stream. Thus, a sensor activation occurring too early might lead to a broken sensor, i.e. to a sensor malfunction, which may lead to an unwanted service stop, i.e. to a vehicle off road condition. Alternatively, the sensors may, due to the imprecise/inexact determination of possible liquid fluid appearance in the exhaust stream, be activated too late, i.e. much later than a point in time at which the liquid fluid was actually eliminated/vaporized in the exhaust stream, which would lead to a possibly suboptimal control of one or more vehicle systems, such as e.g. the exhaust treatment system, and would thus lead e.g. to an inefficient treatment/purification of the exhaust stream.

Also, the conventional solutions are relatively complex solutions that need calibration of a number of parameters. Therefore, the conventional solutions are not very useful in practical implementations, since they need to be calibrated in relation to the parameters of one of a large number of different engines and for one of a large number of exhaust treatment systems when being used in e.g. a vehicle.

An object of the present invention is at least partly solve at least some of the above mentioned problems/disadvantages.

The object is achieved through the above mentioned method for activation of at least one fluid sensitive sensor, i.e. a method for control of an activation of at least one fluid sensitive sensor of an exhaust treatment system arranged for treating an exhaust stream from an engine, the method including:

determining at least one exhaust temperature $T_{exh}$ and at least one exhaust mass flow $\dot{M}_{exh}$ for the exhaust stream;

determining if there is liquid fluid present in the exhaust stream at the at least one fluid sensitive sensor, respectively, based on:

at least one elimination time function $f(T_{exh},\dot{M}_{exh})$, wherein the at least one elimination time function $f(T_{exh},\dot{M}_{exh})$ is based on the at least one determined exhaust temperature $T_{exh}$ and the at least one determined exhaust mass flow $\dot{M}_{exh}$; and a corresponding length of at least one time period $t_{free_of_liquid}$ needed to eliminate a predetermined amount of liquid fluid from the exhaust stream; and controlling an activation of the at least one fluid sensitive sensor based on the determining of if there is liquid fluid present in the exhaust treatment system at the at least one fluid sensitive sensor.

The present invention presents a more exact prediction/determination of whether there is, or is not, liquid fluid in the exhaust system based on time, temperature and mass flow. Hereby, it is with high confidence determined whether the exhaust stream/system is free of liquid fluid, such that the senor(s) can be activated as soon and safe as possible, resulting in a more exact and reliable control of the exhaust treatment system.

Also, the present invention provides for a robust solution, which may easily be practically implemented. The present invention also makes a very little contribution to the costs and complexity of the vehicle/system.

According to an embodiment, if it is determined that the exhaust stream is free of liquid fluid at the at least one fluid sensitive sensor, the at least one fluid sensitive sensor is activated, e.g. by the use of an activation signal $S_{act}$.

Thus, the at least one fluid sensitive sensor is here only activated when it has been determined that there is no liquid fluid, e.g. liquid water, present at the at least one fluid sensitive sensor, whereby the risk for damaged sensors is minimized.

According to an embodiment, the at least one elimination time function $f(T_{exh},\dot{M}_{exh})$ is normalized relative to a shortest time period $t_{free_of_liquid_min}$ needed to eliminate the predetermined amount of liquid fluid from the exhaust stream.

Hereby, the one or more elimination time function $f(T_{exh},\dot{M}_{exh})$ may be easily compared to each other, which facilitates comparisons of different exhaust treatment systems based on the one or more elimination time functions $f(T_{exh},\dot{M}_{exh})$.

According to an embodiment, the at least one elimination time function $f(T_{exh},\dot{M}_{exh})$ is based at least on an exhaust stream convection.

Hereby, a more accurate and reliable determination of if there is still liquid fluid in the exhaust gas may be provided.

According to an embodiment, the at least one elimination time function $f(T_{exh},\dot{M}_{exh})$ is based at least on a friction between the fluid and a rest of the exhaust stream.

Hereby, a more accurate and reliable determination of if there is still liquid fluid in the exhaust gas may be provided.

According to an embodiment, the at least one elimination time function $f(T_{exh},\dot{M}_{exh})$ is determined by:

inserting the predetermined amount of liquid fluid into the exhaust treatment system;

measuring at least one exhaust temperature $T_{exh}$ related to the at least one fluid sensitive sensor, respectively, until the predetermined amount of liquid fluid has been essentially eliminated; and measuring at least one exhaust mass flow $\dot{M}_{exh}$ related to the at least one fluid sensitive sensor, respectively, until the predetermined amount of liquid fluid has been essentially eliminated.

By determining the at least one elimination time function $f(T_{exh},\dot{M}_{exh})$ based on these measurements, a reliable determination of the at least one elimination time function $f(T_{exh},\dot{M}_{exh})$ is achieved, which results in reliable and exact determinations of the presence or not of liquid fluid in the exhaust stream/system. The determination of the at least one elimination time function $f(T_{exh},\dot{M}_{exh})$ may here be performed e.g. in a laboratory and/or testing setup, i.e. not during normal operation of the exhaust system and/or vehicle.

According to an embodiment, the predetermined amount of liquid fluid is determined as having been essentially eliminated by use of at least one temperature sensor.

This is a reliable and low complexity solution for determining the at least one elimination time function $f(T_{exh},\dot{M}_{exh})$.

According to an embodiment, the at least one fluid sensitive sensor includes at least one in the group of:

at least one self-heating sensor;

at least one nitrogen oxides $NO_x$ sensor;

at least one air fuel ratio $\lambda$ sensor;

at least one oxygen $O_2$ sensor;

at least one mass flow $\dot{M}$ sensor; and at least one particle matter PM sensor.

According to an embodiment, the determining of if there is liquid fluid present in the exhaust stream at a first point in time $t_1$ includes:

determining a sum $t_{sum}(t_1)$ of values for the at least one elimination time function $f(T_{exh},M_{exh}^{\bullet})$ until the first point in time $t_1$, respectively; and determining that the exhaust stream is free of liquid fluid at the first point in time $t_1$ if the at least one sum $t_{sum}(t_1)$ of values are greater than at least one lengths of time periods $t_{free_of_liquid}$ needed to eliminate the predetermined amount of liquid fluid from the exhaust stream; $t_{sum}(t_1)>t_{free_of_liquid}$.

By the used summation of the values of the at least one elimination time function $f(T_{exh},M_{exh}^{\bullet})$ a very accurate determination of if there is liquid fluid present in the exhaust stream is achieved.

According to an embodiment, the at least one lengths of time periods $t_{free_of_liquid}$ needed to eliminate the predetermined amount of liquid fluid depend on at least one in the group of:

a geometrical design of the exhaust treatment system;

a surface of at least one inner wall of the exhaust treatment system; and a thermal conductibility of at least one inner wall of the exhaust treatment system.

By basing the at least one length of time period $t_{free_of_liquid}$ on the geometrical design and/or surface or wall features of the system, a more exact value for the at least one lengths of time periods $t_{free_of_liquid}$ is provided, which results in more exact activation of the sensor(s). As is understood by a skilled person, the geometrical design and/or surface or wall features may here relate to one or more of the components included in the exhaust treatment system.

According to an embodiment, the predetermined amount of liquid fluid depends on at least one in the group of:

a usage of a vehicle including the exhaust treatment system;

at least one physical feature of the exhaust treatment system; and at least one ambient condition outside a vehicle including the exhaust treatment system.

By determining the predetermined amount of liquid fluid based on these parameters, a more exact value for the one or more lengths of time periods $t_{free_of_liquid}$ is provided, which results in a more exact activation of the sensor(s).

According to an embodiment, the at least one length of time period $t_{free_of_liquid}$ needed to eliminate the predetermined amount of liquid fluid is in an interval of 2-8 minutes, or in an interval of 4-6 minutes, or is 5 minutes.

Hereby, it is secured that the exhaust stream is free of liquid fluid when the activation of the sensor(s) is performed.

The object is also achieved through the above mentioned control system arranged for control of an activation of at least one fluid sensitive sensor, the system including:

first means arranged for determining at least one exhaust temperature $T_{exh}$ and at least one exhaust mass flow $M_{exh}^{\bullet}$ for the exhaust stream;

second means arranged for determining if there is liquid fluid present in the exhaust stream at the at least one fluid sensitive sensor, respectively, based on:

at least one elimination time function $f(T_{exh},M_{exh}^{\bullet})$, wherein the at least one elimination time function $f(T_{exh},M_{exh}^{\bullet})$ is based on the at least one determined exhaust temperature $T_{exh}$ and the at least one determined exhaust mass flow $M_{exh}^{\bullet}$; and a corresponding length of at least one time period $t_{free_of_liquid}$ needed to eliminate a predetermined amount of liquid fluid from the exhaust stream; and means for controlling an activation of the at least one fluid sensitive sensor based on the determining of if there is liquid fluid present in the exhaust treatment system at the at least one fluid sensitive sensor.

According to an embodiment, if it is determined that the exhaust stream is free of liquid fluid at the at least one fluid sensitive sensor, the control system is arranged for activating the at least one fluid sensitive sensor, e.g. by use of an activation signal $S_{act}$.

According to an embodiment, the second means is arranged for normalizing the at least one elimination time function $f(T_{exh},M_{exh}^{\bullet})$ relative to a shortest time period $t_{free_of_liquid_min}$ needed to eliminate the predetermined amount of liquid fluid from the exhaust stream.

According to an embodiment, the second means is arranged for defining/determining the at least one elimination time function $f(T_{exh},M_{exh}^{\bullet})$ based on at least an exhaust stream convection.

According to an embodiment, the second means is arranged for defining/determining the at least one elimination time function $f(T_{exh},M_{exh}^{\bullet})$ based on at least a friction between the fluid and a rest of the exhaust stream.

According to an embodiment, the second means is arranged for determining the at least one elimination time function $f(T_{exh},M_{exh}^{\bullet})$ by:

inserting the predetermined amount of liquid fluid into the exhaust treatment system;

measuring at least one exhaust temperature $T_{exh}$ related to the at least one fluid sensitive sensor, respectively, until the predetermined amount of liquid fluid has been essentially eliminated; and measuring at least one exhaust mass flow $M_{exh}^{\bullet}$ related to the at least one fluid sensitive sensor, respectively, until the predetermined amount of liquid fluid has been essentially eliminated.

According to an embodiment, the second means is arranged for determining the predetermined amount of liquid fluid as having been essentially eliminated by use of at least one temperature sensor.

According to an embodiment, the at least one fluid sensitive sensor includes one or more in the group of:

at least one self-heating sensor;

at least one nitrogen oxides $NO_x$ sensor;

at least one air fuel ratio $\lambda$ sensor;

at least one oxygen $O_2$ sensor;

at least one mass flow $\dot{M}$ sensor; and at least one particle matter PM sensor.

According to an embodiment, the second means is arranged to in the determination of if there is liquid fluid present in the exhaust stream at a first point in time $t_1$ including:

determining a sum $t_{sum}(t_1)$ of values for the at least one elimination time function $f(T_{exh},M_{exh}^{\bullet})$ until the first point in time $t_1$, respectively; and determining that the exhaust stream is free of liquid fluid at the first point in time $t_1$ if the at least one sum $t_{sum}(t_1)$ of values are greater than at least one length of a time period $t_{free_of_liquid}$ needed to eliminate the predetermined amount of liquid fluid from the exhaust stream; $t_{sum}(t_1)>t_{free_of_liquid}$.

According to an embodiment, the second means is arranged for making the one or more lengths of time periods $t_{free_of_liquid}$ needed to eliminate the predetermined amount of liquid fluid depend on at least one in the group of:

a geometrical design of the exhaust treatment system;

a surface of at least one inner wall of the exhaust treatment system; and a thermal conductibility of at least one inner wall of the exhaust treatment system.

According to an embodiment, the second means is arranged for making the predetermined amount of liquid fluid depend on at least one in the group of:

a usage of a vehicle including the exhaust treatment system;

at least one physical feature of the exhaust treatment system; and at least one ambient condition outside a vehicle including the exhaust treatment system.

According to an embodiment, the second means is arranged for determining the at least one length of a time period $t_{free_of_liquid}$ needed to eliminate the predetermined amount of liquid fluid such that it is in an interval of 2-8 minutes, or in an interval of 4-6 minutes, or is 5 minutes.

BRIEF DESCRIPTION OF THE FIGURES

The embodiments of the invention will be illustrated in more detail below, along with the enclosed drawings, where similar references are used for similar parts, and where.

DETAILED DESCRIPTION OF THE INVENTION

Figure 1:
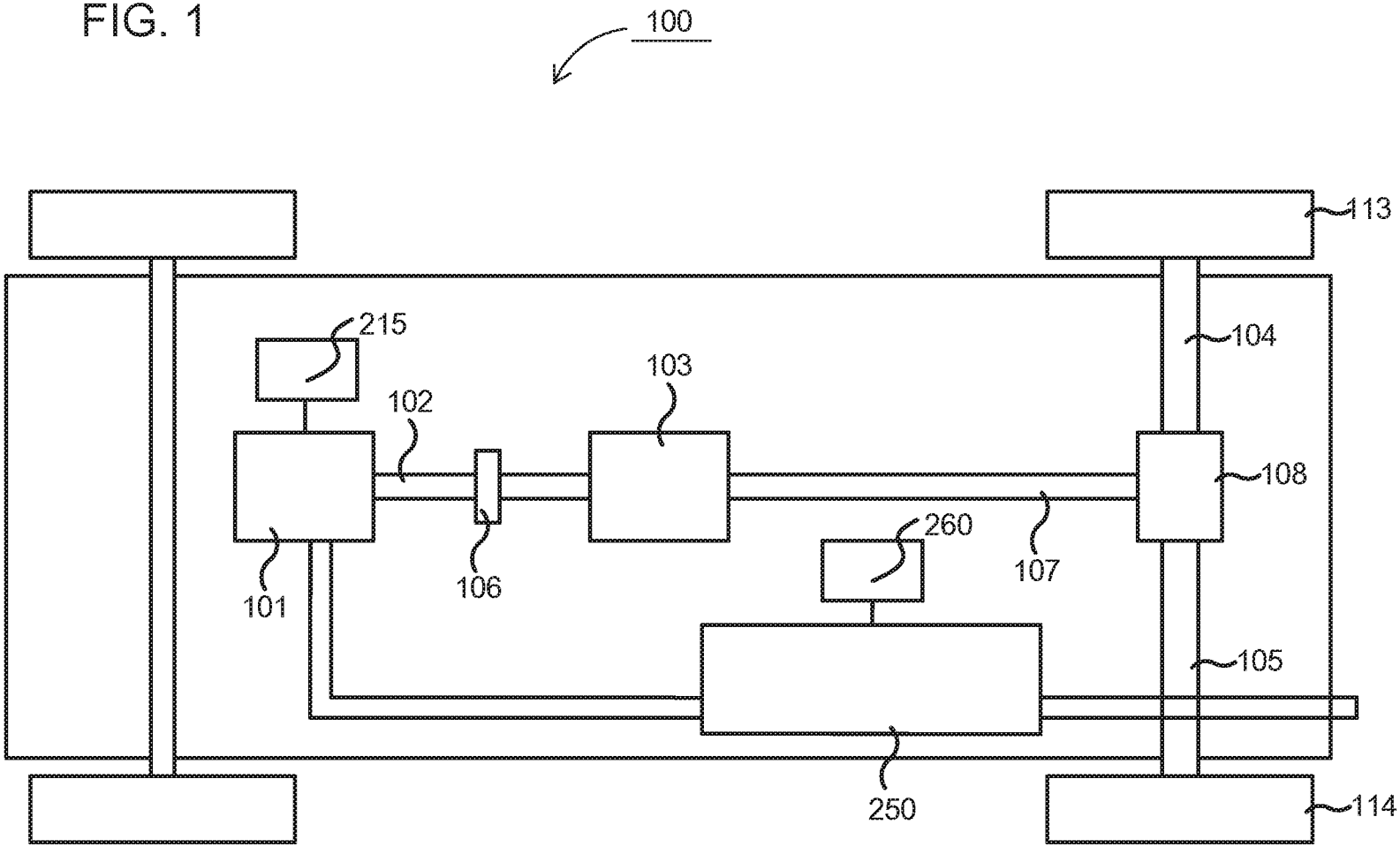
FIG. 1 schematically shows an example vehicle, in which the embodiments of the present invention may be implemented, FIG. 2 schematically shows an example of an exhaust treatment system, in which the embodiments of the present invention may be implemented.

FIG. 1 schematically shows an example vehicle 100 comprising an exhaust treatment system 250. The powertrain comprises a combustion engine 101, which in a customary manner, via an output shaft 102 on the combustion engine 101, usually via a flywheel, is connected to a gearbox 103 via a clutch 106.

The combustion engine 101 is controlled by the engine's control system via a control unit 215. Likewise, the clutch 106 and the gearbox 103 may be controlled by the vehicle's control system, with the help of one or more applicable control devices (not shown). Naturally, the vehicle's powertrain may also be of a number of types, such as a type with a conventional automatic gearbox, of a type with a hybrid powertrain, etc. A Hybrid powertrain may include the combustion engine and at least one electrical motor, such that the power/torque provided to the clutch/gearbox may be provided by the combustion engine and/or the electric motor.

An output shaft 107 from the gearbox 103 drives the wheels 113, 114 via a final drive 108, such as e.g. a customary differential, and the drive shafts 104, 105 connected to the final drive 108.

The vehicle 100 also comprises an exhaust treatment system/exhaust purification system 250 for treatment/purification of exhaust emissions resulting from combustion in the combustion chamber of the combustion engine 101, which may comprise cylinders. The exhaust treatment system 250 may be controlled by an exhaust control unit 260.

Figure 2:
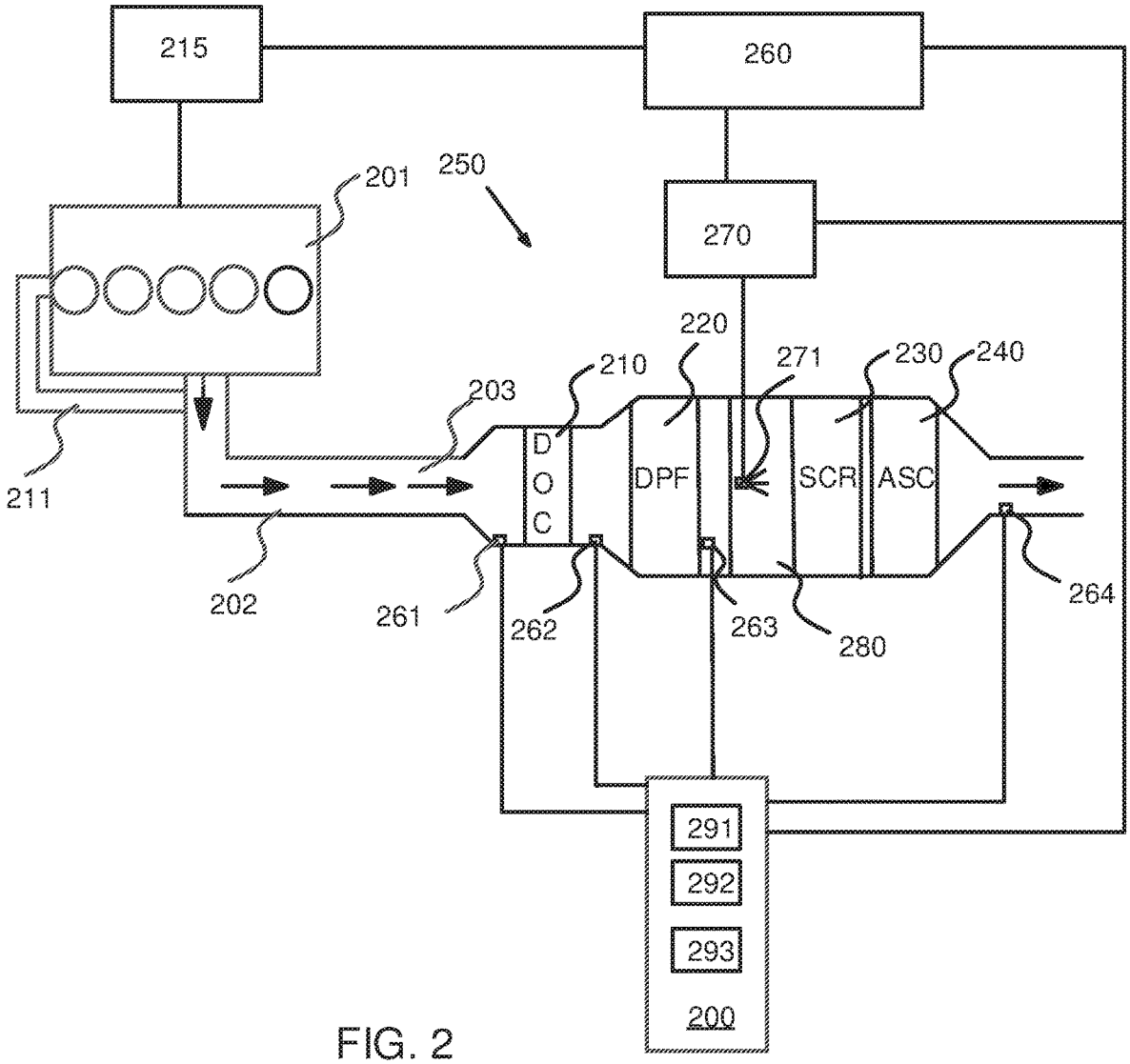

FIG. 2 schematically shows a non-limiting example exhaust treatment system 250, in which the embodiments of the present invention may be implemented. The system 250 is connected to a combustion engine 201 via an exhaust conduit 202, wherein the exhausts generated at combustion, that is to say the exhaust stream 203, is indicated with arrows. The exhaust stream 203 is led to a diesel particulate filter (DPF) 220, via a diesel oxidation catalyst (DOC) 210. During the combustion in the combustion engine, soot particles are formed, and the particulate filter 220 is used to catch these soot particles. The exhaust stream 203 is here led through a filter structure, wherein soot particles from the exhaust stream 203 are caught passing through, and are stored in the particulate filter 220.

The oxidation catalyst DOC 210 has several functions and is normally used primarily to oxidise, during the exhaust treatment, remaining hydrocarbons $C_xH_y$ (also referred to as HC) and carbon monoxide CO in the exhaust stream 203 into carbon dioxide $CO_2$ and water $H_2O$. The oxidation catalyst DOC 210 may also oxidise a large fraction of the nitrogen monoxides NO occurring in the exhaust stream into nitrogen dioxide $NO_2$. The oxidation of nitrogen monoxide NO into nitrogen dioxide $NO_2$ is important for the nitrogen dioxide based soot oxidation in the filter, and is also advantageous at a potential subsequent reduction of nitrogen oxides $NO_x$. In this respect, the exhaust treatment system 250 may further comprise a reduction catalyst device 230, possibly including an SCR (Selective Catalytic Reduction) catalyst, downstream of the particulate filter DPF 220.

A common way of treating exhausts from a combustion engine includes a so-called catalytic purification process, which is why vehicles equipped with a combustion engine usually comprise at least one catalyst. There are different types of catalysts, where the different respective types may be suitable depending on for example the combustion concept, combustion strategies and/or fuel types which are used in the vehicles, and/or the types of compounds in the exhaust stream to be purified. In relation to at least nitrous gases (nitrogen monoxide, nitrogen dioxide), in this document referred to as nitrogen oxides $NO_x$, vehicles often comprise a catalyst, wherein an additive is supplied to the exhaust stream resulting from the combustion in the combustion engine, in order to reduce nitrogen oxides $NO_x$, primarily to nitrogen gas and aqueous vapour.

Selective Catalytic Reduction (SCR) catalysts are for example a commonly used type of catalyst for this type of reduction, primarily for heavy goods vehicles. SCR catalysts usually use ammonia $NH_3$, or a composition from which ammonia may be generated/formed, such as e.g. AdBlue, as an additive to reduce the amount of nitrogen oxides $NO_x$ in the exhausts. The additive is injected into the exhaust stream resulting from the combustion engine upstream of the catalyst. The additive added to the catalyst is adsorbed (stored) in the catalyst, in the form of ammonia $NH_3$, so that a redox-reaction may occur between nitrogen oxides $NO_x$ in the exhausts and ammonia $NH_3$ available via the additive.

SCR catalysts thus use ammonia $NH_3$, or a composition from which ammonia may be generated/formed, e.g. urea, as an additive for the reduction of nitrogen oxides $NO_x$ in the exhaust stream. The reaction rate of this reduction is impacted, however, by the ratio between nitrogen monoxide NO and nitrogen dioxide $NO_2$ in the exhaust stream, so that the reductive reaction is impacted in a positive direction by the previous oxidation of NO into $NO_2$ in the oxidation catalyst DOC. This applies up to a value representing approximately 50% of the molar ratio $NO_2/NO_x$.

As mentioned above, the reduction catalyst device 230, including e.g. the SCR-catalyst, requires additives to reduce the concentration of a compound, such as for example nitrogen oxides $NO_x$, in the exhaust stream 203. Such additive is injected into the exhaust stream upstream of the reduction catalyst device 230 by a dosage device 271, possibly by use of an evaporation chamber/unit 280. The additive may be provided by an additive providing system 270. Such additives often comprise ammonia and/or are urea based, or comprise a substance from which ammonia may be extracted or released, and may for example comprise AdBlue, which basically comprises urea mixed with water. Urea forms ammonia at heating (thermolysis) and at heterogeneous catalysis on an oxidizing surface (hydrolysis), which surface may, for example, comprise titanium dioxide $TiO_2$, within the SCR-catalyst. The additive is evaporated in an evaporation chamber 280. The exhaust treatment system may also comprise a separate hydrolysis catalyst.

The exhaust treatment system 250 may also be equipped with an ammonia slip-catalyst (ASC) 240, which is arranged to oxidise a surplus of ammonia that may remain after the reduction catalyst device 230. Accordingly, the ammonia slip-catalyst ASC may provide a potential for improving the system's total conversion/reduction of $NO_x$.

The exhaust treatment system 250 may also be equipped with one or several sensors, such as one or several $NO_x$, $O_2$, temperature, air fuel ratio λ, particle matter PM and/or mass flow $\dot{M}$ sensors 261, 262, 263, 264 for the determination of measured values for nitrogen oxides, oxygen, temperature, air fuel ratio λ, particle matters PM and/or mass flow in the exhaust treatment system. As mentioned above, some of these sensors may be susceptible to steep temperature gradients, which may be caused by liquid fluid, such as water droplets. Some of these sensors may be self-heating sensors, which are heated up to a predetermined operation temperature before being activated as sensor, i.e. before the sensor provides a sensor signal.

One or more $NO_x$-sensors may for example be positioned upstream 261 of the components of the exhaust treatment system, e.g. upstream of the DOC, downstream of the DOC and upstream of the DPF 262, downstream of the DPF and upstream of the evaporation chamber/unit 263, and/or downstream of the components of the exhaust treatment system, i.e. at the tail pipe 264.

One or more air fuel ratio λ sensors may for example be positioned upstream 261 of the components of the exhaust treatment system, e.g. upstream of a DOC, and/or downstream of the DOC and upstream of the DPF 262.

One or more mass flow $\dot{M}$ sensor may for example be positioned upstream 261 of the components of the exhaust treatment system and/or downstream of the components of the exhaust treatment system, i.e. at the tail pipe 264.

One or more particle matter PM sensor may for example be positioned downstream of the DOC and upstream of the DPF 262, downstream of the DPF and upstream of the evaporation chamber/unit 263 and/or downstream of the components of the exhaust treatment system, i.e. at the tail pipe 264

A control device/system/means 200 may be arranged/configured for performing the embodiments of the present invention. The control device/system/means 200 may at least partly be included in a control device/system/means arranged for controlling the exhaust treatment system and/or in a control device/system/means arranged for controlling one or more SCR catalysts and/or their respective reducing agent injection.

The control device/system/means 200 is in FIG. 2 illustrated as including separately illustrated units 291, 292, 293 arranged for performing the embodiments of the present invention, as is described below. Also, an engine control device/system/means 215 may be arranged for controlling the engine 201, a control system/means 270 may be arranged for controlling the injection of additive, e.g. controlling the dosage device 271, and a control unit 260 may be arranged for controlling the exhaust treatment system. These control device/system/means may be implemented as control device/means 500 described below in connection with FIG. 5 for performing the embodiments of the present invention. These means/units/devices systems 200, 291, 292, 293, 215, 260, 270, 500 may, however be at least to some extent logically separated but physically implemented in at least two different physical units/devices. These means/units/devices 200, 291, 292, 293, 215, 260, 270, 500 may also be at least to some extent logically separated and implemented in at least two different physical means/units/devices. Further, these means/units/devices 200, 291, 292, 293, 215, 260, 270, 500 may be both logically and physically arranged together, i.e. be part of a single logic unit which is implemented in a single physical means/unit/device. These means/units/devices 200, 291, 292, 293, 215, 260, 270, 500 may for example correspond to groups of instructions, which may be in the form of programming code, that are input into, and are utilized by at least one processor when the units are active and/or are utilized for performing its method step, respectively. It should be noted that the control system/means 200 may be implemented at least partly within the vehicle 100 and/or at least partly outside of the vehicle 100, e.g. in a server, computer, processor or the like located separately from the vehicle 100.

As mentioned above, the units 291, 292, 293 described above correspond to the claimed means 291, 292, 293 arranged for performing the embodiments of the present invention, and the present invention as such.

FIG. 2 only illustrates one example of the exhaust treatment systems in which the embodiments of the present invention may be implemented. The present invention is, of course, not at all limited to usage in only the herein illustrated system. Instead, the embodiments of the present invention may be used in essentially any exhaust treatment system including at least one fluid sensitive sensor. Thus, the exhaust treatment system may include essentially any component, and any number of components, in essentially any configuration arranged for purifying the exhaust stream, as long as the system includes at least one fluid sensitive sensor. For example, the exhaust treatment systems are not restricted to having only one SCR catalyst, and may thus include two or more SCR catalysts.

In this document, the principles of the herein described embodiments are often explained in relation to a fluid sensitive sensor, e.g. a water sensitive sensor, exemplified as a nitrogen oxides $NO_x$ sensor. However, the principles of the herein described embodiments are applicable to essentially any fluid sensitive sensor, e.g. any self-heating sensors, nitrogen oxides $NO_x$ sensors, air fuel ratio λ sensors, oxygen $O_2$ sensors, mass flow $\dot{M}$ sensors and/or particle matter PM sensors, as mentioned above.

A $NO_x$ sensor, and other herein mentioned fluid sensitive sensors, may be constituted in a large number of ways. As a non-limiting example can be mentioned that fluid sensitive $NO_x$ sensors may have a measuring principle based on a ceramic, being a heatable sensor element, which separates molecules and measures the concentration of nitrogen oxides $NO_x$. The $NO_x$ sensor may have at least two chambers/cavities arranged within the ceramic sensor element, between which the exhaust gas may diffuse, e.g. by the exhaust gas stream entering into the first chamber/cavity and moving on into the second cavity. An electric heating element is arranged for heating the ceramic sensor element, and thereby also for heating the at least two chambers/cavities. A voltage is applied over the first chamber/cavity, whereby most of the oxygen is removed from the gas, and the nitrogen dioxide $NO_2$ in the gas form nitrogen monoxide NO. When the gas diffuses to a second chamber/cavity, the rest of the oxygen is pumped out from the second chamber/cavity, and the nitrogen monoxide NO dissociates on an electrode into oxygen and nitrogen; $2NO \rightarrow O_2+N_2$. A current provided by an oxygen pump of the second chamber/cavity is proportional to the concentration of nitrogen oxides $NO_x$ in exhaust gas stream entering the first chamber/cavity, and may be used as a sensor signal related to the concentration of nitrogen oxides $NO_x$. Of course, fluid sensitive sensors may also be designed in other ways than described above, but may still use the properties of a heatable sensor element, often being a ceramic sensor element.

The heated sensor element, i.e. the heated ceramic material, is very susceptible to cracking if its temperature gradient is too steep, such as when a fluid/water droplet hits the heated sensor element, as explained above. Therefore, the sensor is normally started after all liquid fluid/water is believed to be eliminated from the exhaust system. After the engine is started, the exhaust gas stream starts to warm up the exhaust treatment system to above the dew point temperature and liquid fluid/water in the system starts to evaporate. Traditionally, when the fluid/water has been evaporated, the $NO_k$ sensor may be activated. It has thus been important to be able to determine exactly when the sensor can be safely activated, without risk for cracking due to liquid fluid/water still being present in the exhaust gas stream.

Figure 3A:
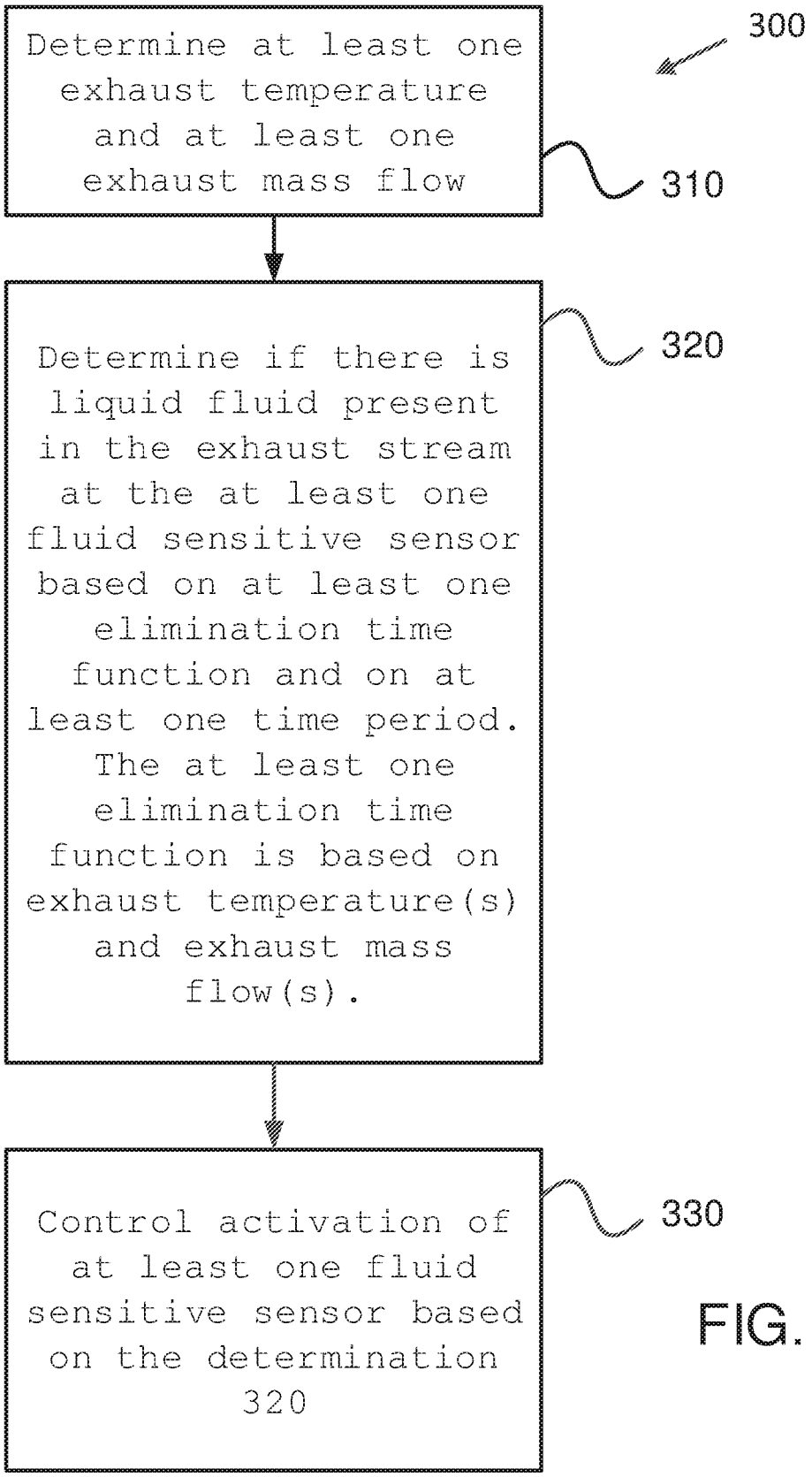
FIGS. 3*a-b* show flow charts for some embodiments of the method according to the present invention, FIG. 4 schematically shows an illustration of example elimination time functions an example free of liquid fluid map, according to some embodiments of the present invention.

FIG. 3*a* shows a flow chart diagram illustrating a method 300 according to an embodiment of the present invention.

The method 300 controls an activation of at least one fluid sensitive sensor 261, 262, 263, 264 of an exhaust treatment system 250 arranged for treating an exhaust stream 203 being output from an engine 101.

In a first step 310 of the method, at least one exhaust temperature $T_{exh}$ for the exhaust stream and at least one exhaust mass flow $M_{exh}^{\bullet}$ for the exhaust stream being related to the position/location of the at least one fluid sensitive sensor 261, 262, 263, 264 of the exhaust treatment system 250, respectively, are determined.

In a second step 320 of the method, it is determined if there is liquid fluid, e.g. liquid water, present in the exhaust stream 203 at the at least one fluid sensitive sensor 261, 262, 263, 264, respectively. This determination, related to the possible presence of liquid fluid, is based on at least one elimination time function $f(T_{exh},M_{exh}^{\bullet})$ related to the at least one fluid sensitive sensor 261, 262, 263, 264, respectively. The at least one elimination time function $f(T_{exh},M_{exh}^{\bullet})$ is based on, i.e. takes into consideration, the at least one determined exhaust temperature $T_{exh}$ and the at least one determined exhaust mass flow $M_{exh}^{\bullet}$ which are related to the at least one fluid sensitive sensor 261, 262, 263, 264, respectively. The determination 320, related to the possible presence of liquid fluid, is also based on a corresponding length of at least one time period $t_{free_of_liquid}$ needed to eliminate a predetermined amount of liquid fluid from the exhaust stream 203, e.g. at the at least one fluid sensitive sensor 261, 262, 263, 264, respectively, as explained more in detail below.

In a third step 330 of the method, an activation of the at least one fluid sensitive sensor 261, 262, 263, 264 is based on the determination 320 in the second step of if there is liquid fluid present in the exhaust treatment system 250 at the at least one fluid sensitive sensor 261, 262, 263, 264.

For example, if it is determined 320 that the exhaust stream 203 is free of liquid fluid at the at least one fluid sensitive sensor 261, 262, 263, 264, it may be concluded that it is safe to activate that at least one sensor. Therefore, the at least one fluid sensitive sensor 261, 262, 263, 264 is then, according to an embodiment of the present invention, activated by the control 330 of the third step 330, wherein the activation is effected for example by use of an activation signal $S_{act}$ sent e.g. to the at least one liquid fluid free sensor and/or to a control unit controlling the at least one sensor.

By usage of the method, an accurate, robust and low complex determination/prediction of if there is liquid fluid left in the exhaust stream at the sensors is achieved. This is possible since the determination/prediction is based on an exhaust stream convection and/or on a friction between the fluid and a rest of the exhaust stream, as is explained below. After the engine is started, the exhaust gas stream starts to warm up and liquid fluid in the system starts to evaporate, also dependent on the convection. Liquid fluid may also start to be blown out from the system, due to the friction.

When it has been determined that the fluid has eliminated from the system, the $NO_x$ sensor is activated. Hereby the risk for damaged sensors due to fluid splashes is greatly reduced. Therefore, also the risk for suboptimal control of the exhaust treatment system and/or for vehicle service stops are reduced when the method is used in a vehicle.

According to an embodiment of the present invention, the at least one elimination time function $f(T_{exh}, M_{exh}^{\bullet})$ and therefore also the determination of if there is liquid fluid present in the exhaust stream and the control of the activation of the sensors, is based on at least an exhaust stream convection, i.e. takes the convection into consideration.

According to an embodiment of the present invention, the at least one elimination time function $f(T_{exh}, M_{exh}^{\bullet})$ and therefore also the determination of if there is liquid fluid present in the exhaust stream and the control of the activation of the sensors, is based on at least a friction between the fluid and a rest of the exhaust stream 203, i.e. takes the friction into consideration.

As mentioned above, the one or more elimination time functions $f(T_{exh},M_{exh}^{\bullet})$ take the at least one determined exhaust temperature $T_{exh}$ and the at least one determined exhaust mass flow $M_{exh}^{\bullet}$ into consideration, that are related to the at least one fluid sensitive sensor 261, 262, 263, 264, respectively. Hereby, it is possible to base the determination 320 of if there is liquid fluid present in the exhaust stream on the exhaust stream convection and/or the friction between the fluid and a rest of the exhaust stream.

When the determination 320 of if there is liquid fluid present in the exhaust stream is based also on the exhaust stream convection and/or the friction, as in these embodiments, the usage and/or the driving style of the driver may be taken into consideration, which increases the accuracy of the determination. For example, if the vehicle is aggressively driven, the determined exhaust mass flows $M_{exh}^{\bullet}$ increase. As a result of the greater mass flows $M_{exh}^{\bullet}$, the fluid droplets are supplied/provided with more energy than for smaller mass flows $M_{exh}^{\bullet}$, which increases the evaporation speed. In other words, at higher temperatures and greater mass flows $M_{exh}^{\bullet}$ the evaporation speed of the liquid fluid is increased. Thus, when convection is taken into consideration, a more accurate determination of the presence of liquid fluid can be achieved. This may e.g. result in a faster activation of the one or more sensors at relatively high exhaust mass flows $M_{exh}^{\bullet}$.

At greater mass flows $M_{exh}^{\bullet}$, the liquid fluid droplets may also follow the other particles of the exhaust stream out from the exhaust treatment system. Thus, due to the friction between the fluid droplets and the rest of the exhaust stream, the fluid droplets may, at greater mass flows $M_{exh}^{\bullet}$, fasten/hook on to other parts/molecules/particles of the exhaust stream, and may follow the stream out from the system. Thus, at greater mass flows $M_{exh}^{\bullet}$, some liquid fluid droplets are eliminated from the exhaust treatment system by the friction. Therefore, when the friction is taken into consideration, a more accurate determination of the presence of liquid fluid can be achieved. This may e.g. result in a faster activation of the one or more sensors at relatively high exhaust mass flows $M_{exh}^{\bullet}$.

Figure 3B:
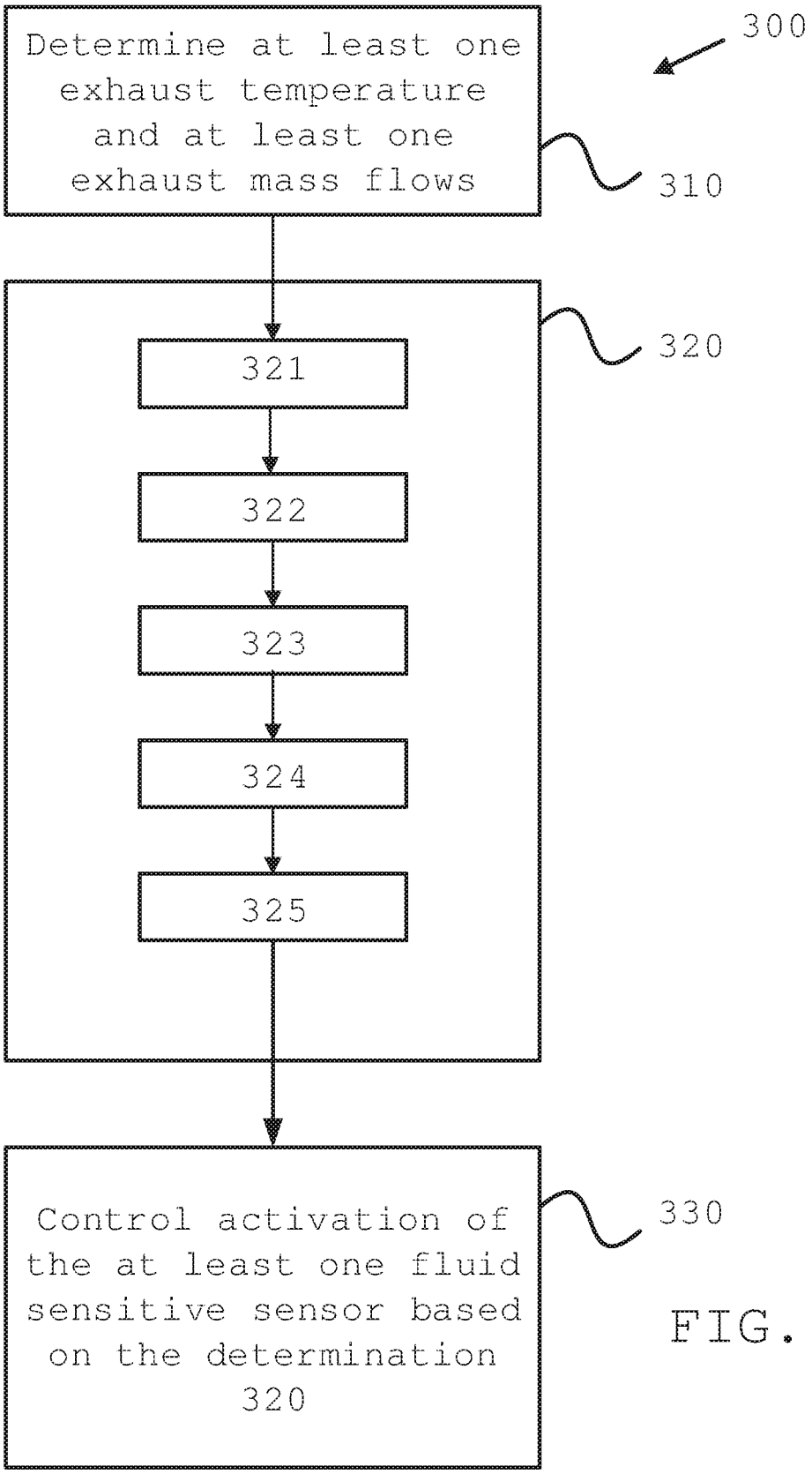

According to an embodiment of the present invention, illustrated in the flow chart diagram in FIG. 3*b*, the determination 320 of if there is liquid fluid present in the exhaust stream 203 includes a determination of the at least one elimination time function $f(T_{exh}, M_{exh}^{\bullet})$ related to the at least one or more fluid sensitive sensor 261, 262, 263, 264.

The determination of the at least one elimination time function $f(T_{exh},M_{exh}^{\bullet})$ includes the step of inserting 321 the predetermined amount of liquid fluid into the exhaust treatment system 250. Then, the temperatures and exhaust mass flows are analyzed during the elimination of this predetermined amount of liquid fluid. Thus, at least one sensor related exhaust temperature $T_{exh}$ is then measured 322 in the exhaust treatment system, e.g. at the at least one fluid sensitive sensor 261, 262, 263, 264, respectively, until the predetermined amount of liquid fluid has been essentially eliminated. Also, at least one sensor related exhaust mass flow $M_{exh}^{\bullet}$ is measured 323 in the exhaust treatment system, e.g. at the one or more fluid sensitive sensors 261, 262, 263, 264, respectively, until the predetermined amount of liquid fluid has been essentially eliminated. The predetermined amount of liquid fluid has here been essentially eliminated after a free of liquid fluid time period $t_{free_of_liquid}$, wherefore the corresponding at least one liquid fluid elimination time periods $t_{free_of_liquid}$ may also be determined based on these measurements. The determination of the at least one elimination time function $f(T_{exh}, M_{exh}^{\bullet})$ may be performed in a laboratory or testing set up.

Figure 4:
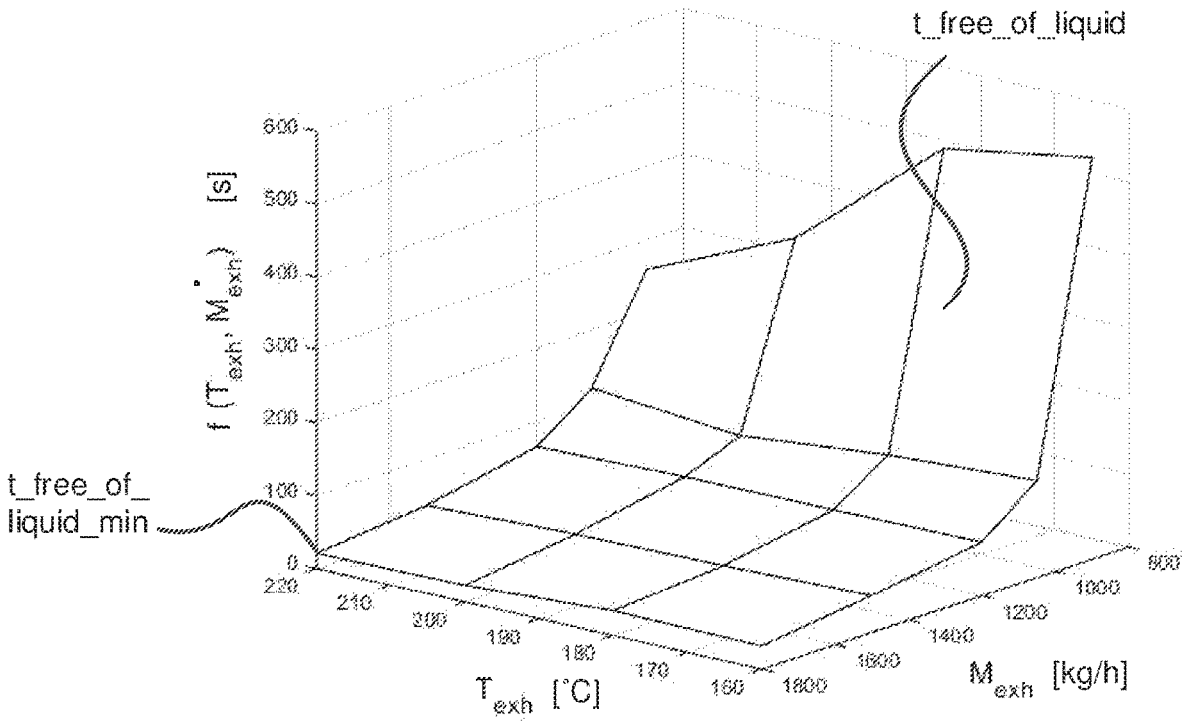

This is illustrated in a non-liming example in FIG. 4, in which the elimination time function $f(T_{exh},M_{exh}^{\bullet})$ denoted "Time to fluid elimination (s)" in FIG. 4 is determined as a function of the exhaust temperature $T_{exh}$ and the exhaust gas mass flows $M_{exh}^{\bullet}$ until there is no liquid fluid left after the free of liquid fluid time period $t_{free_of_liquid}$. As is illustrated in FIG. 4, it takes much longer to eliminate the liquid fluid at lower exhaust mass flows $M_{exh}^{\bullet}$ and at lower temperatures $T_{exh}$. Correspondingly, the shortest liquid fluid elimination time periods $t_{free_of_liquid_min}$ are measured for the highest temperatures $T_{exh}$ and the highest exhaust mass flows $M_{exh}^{\bullet}$. The free of liquid time periods $t_{free_of_liquid}$ may be defined/seen as a free of liquid map, i.e. as a fluid elimination map, which indicates how long time it takes to eliminate the predetermined amount of liquid fluid for the various combinations of exhaust mass flows $M_{exh}^{\bullet}$ and temperatures $T_{exh}$.

One such elimination time function $f(T_{exh}, M_{exh}^{\bullet})$ and the corresponding free of liquid map, may be determined for each type of exhaust treatment system. According to an embodiment, two or more such elimination time functions $f(T_{exh}, M_{exh}^{\bullet})$ and the corresponding free of liquid maps, may be determined for each kind of exhaust treatment system, e.g. for two or more positions corresponding to those of the fluid sensitive sensors.

It should be noted that the mass flow and temperature sensors used for determining the at least one elimination time function $f(T_{exh}, M_{exh}^{\bullet})$ i.e. the sensors used for determining the exhaust mass flows $M_{exh}^{\bullet}$ and temperatures $T_{exh}$ related to the at least one fluid sensitive sensor 261, 262, 263, 264 do not have to correspond to the one or more fluid sensitive sensors 261, 262, 263, 264. Instead, the sensors used for determining the exhaust mass flows $M_{exh}^{\bullet}$ and temperatures $T_{exh}$ related to the at least one fluid sensitive sensor 261, 262, 263, 264 may be placed/located at least partly apart from, i.e. at least partly in other locations than, the at least one fluid sensitive sensor 261, 262, 263, 264, just as long as the measurements made at the sensors used for determining the exhaust mass flows $M_{exh}^{\bullet}$ and temperatures $T_{exh}$ are related to the at least one fluid sensitive sensor 261, 262, 263, 264 in some way. For example, the sensors used for determining the exhaust mass flows $M_{exh}^{\bullet}$ and temperatures $T_{exh}$ may be placed away from the one or more fluid sensitive sensors 261, 262, 263, 264 if the sensors are related such that the conditions at the one or more fluid sensitive sensors 261, 262, 263, 264 may be determined/calculated/predicted based on the measurements of the sensors used for determining the exhaust mass flows $M_{exh}^{\bullet}$ and temperatures $T_{exh}$.

At least one temperature sensor 261, 262, 263, 264 may here be used for determining that the predetermined amount of liquid fluid has been essentially eliminated. For example, due to the fact that liquid water at known conditions has a temperature equal to or lower than a well-known temperature, such as e.g. 100° C., it may be determined if the liquid water is eliminated based on the temperature. For example, if the measured temperature is 100° C. or lower, it may be concluded that the temperature sensor is under water, since the exhaust gases are much warmer. Thus, if the measured temperature quickly raises from 100° C. to the normal temperature of the exhaust gases, which is much higher, e.g. 700-900° C., it may be concluded that the liquid water has evaporated such that the temperature sensor is now surrounded by the much warmer exhaust gases.

According to an embodiment, the at least one determined elimination time function $f(T_{exh},M_{exh}^{\bullet})$ is normalized relative to the shortest time period $t_{free_of_liquid_min}$ needed to eliminate the predetermined amount of liquid fluid from the exhaust stream 203, e.g. at one of the at least one fluid sensitive sensors 261, 262, 263, 264. In the non-limiting example illustrated in FIG. 4, the elimination time function $f(T_{exh},M_{exh}^{\bullet})$ would thus be normalized relative to the function of the bottom left point, i.e. for the highest exhaust mass flows $M_{exh}^{\bullet}$ and the highest temperatures $T_{exh}$.

According to an embodiment, the predetermined amount of liquid fluid, e.g. liquid water, used for determining the at least one elimination time function $f(T_{exh},M_{exh}^{\bullet})$ and the at least one liquid elimination time period $t_{free_of_liquid}$, is chosen long enough to cover the most probable cases for the vehicle/system, but short enough for not unnecessary delaying the activation of the one or more sensors. Basically, the larger the predetermined amount of liquid fluid is, the longer the free of liquid fluid time $t_{free_of_liquid}$ gets. Thus, if the predetermined amount of liquid fluid is very large, possibly close to a worst-case scenario, for example 5 liters, then it can be assured that the exhaust gas stream will be free of liquid fluid when the one or more sensors are activated. However, the exhaust gas stream may then already have been free of liquid fluid during a relatively long time when the one or more sensors are activated, which may be problematic since the control of the exhaust treatment system may be executed in a sub-optimized way during this time. Instead, the predetermined amount of liquid fluid should, according to an embodiment, be a tradeoff and may be chosen so that it just covers the probably occurring situations, i.e. the probable amounts of fluid that will occur in the system/gas stream, i.e. such that it covers normal driving/operation conditions.

According to an embodiment, the predetermined amount of liquid fluid used for determining the at least one elimination time function $f(T_{exh},M_{exh}^{\bullet})$ and the at least one liquid fluid elimination time period $t_{free_of_liquid}$ is dependent on a usage of the vehicle 100 including the exhaust treatment system 250. For example, if the vehicle usage indicates that the vehicle has relatively many cold starts, this may be an indication that there is a risk that a relatively large amount of liquid fluid will form in the exhaust treatment system, wherefore the predetermined amount of liquid fluid may be relatively greater.

The predetermined amount of liquid fluid may also, according to an embodiment, depend on at least one physical feature of the exhaust treatment system 250, where this at least one feature may have an influence of the ability for the system to accumulate liquid fluid. Thus, if the exhaust treatment system 250 has one or more physical features indicating that liquid fluid may easily be accumulated in the system, the predetermined amount of liquid fluid used for determining the at least one elimination time function $f(T_{exh}, M_{exh}^{\bullet})$ and the at least one liquid fluid elimination time period $t_{free_of_liquid}$ may be relatively greater.

The predetermined amount of liquid fluid may also, according to an embodiment, depend on at least one ambient condition outside a vehicle 100 including the exhaust treatment system 250. Thus, if a weather forecast predicts heavy rain and/or if an upcoming route/road section is known to e.g. have deep water puddles, pools or river crossings, this may be an indication that there is a risk that fluids, such as water, will enter into the system from the outside, and that the predetermined amount of liquid fluid should be relatively greater. The road conditions ahead of the vehicle may be determined based on vehicle positioning information, digital map information, radar-based information, camera-based information, information obtained from other vehicles than the vehicle 100, road information and/or positioning information stored previously on board the vehicle 100, and/or information obtained from traffic systems related to that route/road section.

The information related to the upcoming route/road section may be obtained in various ways. It may be determined on the basis of map data, e.g. from digital maps including, in combination with positioning information, e.g. GPS (global positioning system) information. The positioning information may be used to determine the location of the vehicle relative to the map data so that the road section information may be extracted from the map data. Various present-day cruise control systems use map data and positioning information. Such systems may then provide the system for the embodiments of the present invention with map data and positioning information, thereby minimizing the additional complexity involved in determining the road section information.

According to an embodiment, the determination 320 of if there is liquid fluid present in the exhaust stream 203 at a first point in time $t_1$ includes the step of determining 324 a sum $t_{sum}(t_1)$ of values for the at least one elimination time function $f(T_{exh},M_{exh}^{\bullet})$ until the first point in time $t_1$, respectively. This sum may e.g. be calculated as an integral $t_{sum}(t_1)=\int_0^{t_1} f(T_{exh},M_{exh}^{\bullet})$.

Further, the sum $t_{sum}(t_1)$ may then be used for determining 325 if the exhaust stream 203 is free of liquid fluid, e.g. at the at least one fluid sensitive sensor 261, 262, 263, 264, respectively, at the first point in time $t_1$ if the at least one sum $t_{sum}(t_1)$ of values is greater than the at least one length of a time period $t_{free_of_fluid}$ needed to eliminate the predetermined amount of liquid fluid from the exhaust stream, e.g. at the at least one fluid sensitive sensor 261, 262, 263, 264; $t_{sum}(t_1)>t_{free_of_liquid}$; respectively.

Thus, the at least one sum $t_{sum}(t_1)$ may be seen as a kind of aggregated and/or weighted time value at the first point in time $t_1$, which value depends on the exhaust mass flows $M_{exh}^{\bullet}$ and temperatures $T_{exh}$ up until the first point in time $t_1$. The comparison of the at least one sum $t_{sum}(t_1)$ with the at least one length of the time period $t_{free_of_liquid}$, respectively, in order to determine 325 if the exhaust stream 203 is free of liquid fluid, may be visualized as a comparison of the at least one sum $t_{sum}(t_1)$ with the free of liquid map illustrated in FIG. 4. Thus, if the sum $t_{sum}(t_1)$ exceeds the free of liquid map in FIG. 4, then the exhaust treatment system is determined to be free of liquid fluid at the first point in time $t_1$, and for the exhaust mass flows $M_{exh}^{\bullet}$ and temperatures $T_{exh}$ for which the sum $t_{sum}(t_1)$ is calculated/aggregated.

According to an embodiment, the at least one length of the time period $t_{free_of_liquid}$ needed to eliminate the predetermined amount of liquid fluid, that is used in the above described determination 320 of if there is liquid fluid in the exhaust gas, may depend on a geometrical design of the exhaust treatment system, on a surface of at least one inner wall of the exhaust treatment system and/or on a thermal conductibility of at least one inner wall of the exhaust treatment system. Thus, the values of the at least one liquid elimination time periods $t_{free_of_liquid}$ may depend on how the components of the exhaust treatment system are configured, e.g. regarding sizes, diameters, materials, geometrical distances, geometrical shapes and/or geometrical proportions, and/or how the gas is lead through the components. For example, if deeper fluid/water filled pockets are present due to the geometrical design, the one or more lengths of time periods $t_{free_of_liquid}$ needed to eliminate the predetermined amount of liquid fluid may be longer. Also, the initial temperature for the fluid may influence the one or more lengths of time periods $t_{free_of_liquid}$ needed to eliminate the predetermined amount of liquid fluid. For example, frozen water (ice) takes longer time to eliminate than warmer liquid water.

Also, the features of the component inner walls and/or the features of the inside of the system piping may influence the values of the at least one liquid fluid elimination time period $t_{free_of_liquid}$. For example, a smooth/even surface may result in that liquid fluid is more quickly blown out from the system due to the friction than an uneven/rugged surface may result in. However, an uneven/rugged surface may result in a quicker fluid heating due to its larger contact surface towards the fluid, which makes the evaporation quicker. Thus, the constitution of the surface may influence the elimination time period $t_{free_of_liquid}$.

As mentioned above, the one or more elimination time functions $f(T_{exh},M_{exh}^{\bullet})$ may be determined by inserting 321 a predetermined amount of liquid fluid into the exhaust treatment system 250, and then measuring 322 one or more exhaust temperatures $T_{exh}$ and one or more exhaust mass flows $M_{exh}^{\bullet}$ until the predetermined amount of liquid fluid has been essentially eliminated. When the predetermined amount of liquid fluid has been essentially eliminated, the at least one liquid fluid elimination time period $t_{free_of_liquid}$ may then be determined as the point in time when the exhaust gas and/or system is free of liquid fluid. The at least one liquid fluid elimination time period $t_{free_of_fluid}$ may also be determined based on empirical tests, and may then be set to predetermined time values. The at least one length of the time period $t_{free_of_liquid}$ needed to eliminate the predetermined amount of liquid fluid may, according to an embodiment, be determined and/or empirically deduced to be in an interval of 2-8 minutes, or in an interval of 4-6 minutes, or may be 5 minutes.

A person skilled in the art will realise that a method for controlling an activation of at least one fluid sensitive sensor 261, 262, 263, 264 of an exhaust treatment system 250 according to the embodiments of the present invention may also be implemented in a computer program, which when executed in a computer will cause the computer to execute the method. The computer program usually forms a part of a computer program product 503, wherein the computer program product comprises a suitable digital non-volatile/permanent/persistent/durable storage medium on which the computer program is stored. The non-volatile/permanent/persistent/durable computer readable medium includes a suitable memory, e.g.: ROM (Read-Only Memory), PROM (Programmable Read-Only Memory), EPROM (Erasable PROM), Flash, EEPROM (Electrically Erasable PROM), a hard disk device, etc.

Figure 5:
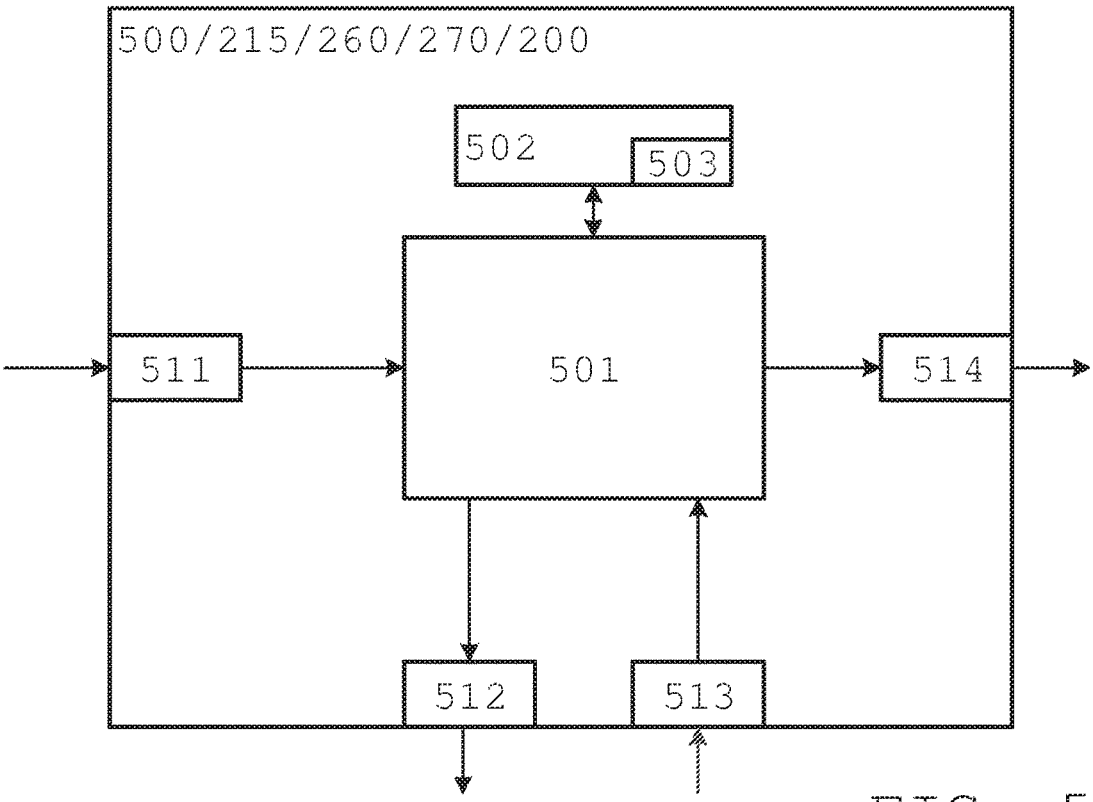
FIG. 5 shows a control device/unit, in which the embodiments of the present invention may be implemented.

FIG. 5 schematically shows a control device/means 500. The control device/means 500 comprises a calculation unit 501, which may include essentially a suitable type of processor or microcomputer, e.g. a circuit for digital signal processing (Digital Signal Processor, DSP), or a circuit with a predetermined specific function (Application Specific Integrated Circuit, ASIC). The calculation unit 501 is connected to a memory unit 502, installed in the control device/means 500, providing the calculation device 501 with e.g. the stored program code and/or the stored data, which the calculation device 501 needs in order to be able to carry out calculations. The calculation unit 501 is also set up to store interim or final results of calculations in the memory unit 502.

Further, the control device/means 500 is equipped with devices 511, 512, 513, 514 for receiving and sending of input and output signals, respectively. These input and output signals may contain wave shapes, pulses, or other attributes, which may be detected as information by the devices 511, 513 for the receipt of input signals, and may be converted into signals that may be processed by the calculation unit 501. These signals are then provided to the calculation unit 501. The devices 512, 514 for sending output signals are arranged to convert the calculation result from the calculation unit 501 into output signals for transfer to other parts of the vehicle's control system, and/or the component(s) for which the signals are intended.

Each one of the connections to the devices for receiving and sending of input and output signals may include one or several of a cable; a data bus, such as a CAN (Controller Area Network) bus, a MOST (Media Oriented Systems Transport) bus, or any other bus configuration; or of a wireless connection.

A person skilled in the art will realise that the above-mentioned computer may consist of the calculation unit 501, and that the above-mentioned memory may consist of the memory unit 502.

Generally, control systems in modern vehicles include of a communications bus system, comprising one or several communications buses to connect a number of electronic control devices (ECUs), or controllers, and different components localised on the vehicle. Such a control system may comprise a large number of control devices, and the responsibility for a specific function may be distributed among more than one control device. Vehicles of the type shown thus often comprise significantly more control devices than what is shown in FIGS. 1, 2 and 5, which is well known to a person skilled in the art within the technology area.

As a person skilled in the art will realise, the control device/means 500 in FIG. 5 may comprise and/or illustrate one or several of the control devices/systems/means 215 and 260 in FIG. 1, or the control devices/systems/means 215, 260, 270, 200 in FIG. 2. The control device/means 200 schematically in FIG. 2 is arranged for performing the embodiments of the present invention. The units/means 291, 292, 293 may for example correspond to groups of instructions, which can be in the form of programming code, that are input into, and are utilized by a processor when the units are active and/or are utilized for performing its method step, respectively.

The embodiments of the present invention, in the embodiment shown, may be implemented in the control device/means 500. The embodiments of the invention may, however, also be implemented wholly or partly in one or several other control devices, already existing at least partly within or outside the vehicle, or in a control device dedicated to the embodiments of the present invention at least partly within or outside of the vehicle.

According to an aspect of the present invention, a control system 200 arranged for control of an activation of at least one fluid sensitive sensor 261, 262, 263, 264 of an exhaust treatment system 250 is disclosed. As described above, the exhaust stream 203 is produced by an engine 201, and is then treated by an exhaust treatment system 250 arranged for treating/purifying the exhaust stream 203 from the engine 101.

The control system 200 includes a first means 291, e.g. a first determination unit 291, arranged for determining 310 at least one exhaust temperature $T_{exh}$ and at least one exhaust mass flow $M_{exh}^{\bullet}$ for the exhaust stream 203 related to at least one fluid sensitive sensor 261, 262, 263, 264 of the exhaust treatment system 250, respectively.

The control system 200 also includes a second means 292, e.g. a second determination unit 292, arranged for determining 320 if there is liquid fluid present in the exhaust stream 203 at the at least one fluid sensitive sensor 261, 262, 263, 264, respectively, based on at least one elimination time function $f(T_{exh}, M_{exh}^{\bullet})$. The at least one elimination time function $f(T_{exh}, M_{exh}^{\bullet})$ is here based on the at least one determined exhaust temperature $T_{exh}$ and the at least one determined exhaust mass flow $M_{exh}^{\bullet}$, and is also based on a corresponding length of at least one time period $t_{free_of_liquid}$ needed to eliminate a predetermined amount of liquid fluid from the exhaust stream 203.

The control system 200 further includes means 293, e.g. a control unit 293, arranged for controlling 330 an activation of the at least one of the one or more fluid sensitive sensors 261, 262, 263, 264 based on the determination 320 of if there is liquid fluid present in the exhaust stream/treatment system 250 at the at least one fluid sensitive sensor 261, 262, 263, 264.

The control system 200 may be arranged/modified for performing any of the in this document described embodiments of the method according to the present invention.

As mentioned above, the exhaust treatment system 250 shown in FIG. 2 is only a non-limiting example of an exhaust treatment system 250, including only one DOC 210, only one DPF 220, only one dosage device 271, only one evaporation chamber 280, only one reduction catalyst device 230, and only one reduction catalyst device 230, ASC 240 for pedagogic reasons. It should, however, be noted that the present invention is not restricted to such systems, and may instead be generally applicable in any exhaust treatment system including one or more DOCs, one or more DPFs, one or more dosage devices, one or more evaporation chambers, one or more reduction catalyst devices, and one or more ASCs. For example, the embodiments of the present invention is especially applicable on systems including a first dosage device, possibly a first evaporation chamber, a first reduction catalyst device, a second dosage device, possibly a second evaporation chamber and a second reduction catalyst device. Each one of the first and second reduction catalyst devices may include at least one SCR-catalyst, at least one ammonia slip catalyst ASC, and/or at least one multifunctional slip-catalyst SC. The multifunctional slip catalyst SC may be arranged primarily for reduction of nitrogen oxides $NO_x$, and secondarily for oxidation of additive in the exhaust stream. The multifunctional slip catalyst SC may also be arranged for performing at least some of the functions normally performed by a DOC, e.g. oxidation of hydrocarbons $C_xH_y$ (also referred to as HC) and carbon monoxide CO in the exhaust stream 203 into carbon dioxide $CO_2$ and water $H_2O$ and/or oxidation of nitrogen monoxides NO occurring in the exhaust stream into nitrogen dioxide $NO_2$.

The present invention is also related to a vehicle 100, such as e.g. a truck, a bus or a car, including the herein described control system 200 for arranged for controlling an activation of at least one fluid sensitive sensor.

The inventive method, and embodiments thereof, as described above, may at least in part be performed with/using/by at least one device. The inventive method, and embodiments thereof, as described above, may be performed at least in part with/using/by at least one device that is suitable and/or adapted for performing at least parts of the inventive method and/or embodiments thereof. A device that is suitable and/or adapted for performing at least parts of the inventive method and/or embodiments thereof may be one, or several, of a control unit, an electronic control unit (ECU), an electronic circuit, a computer, a computing unit and/or a processing unit.

With reference to the above, the inventive method, and embodiments thereof, as described above, may be referred to as an, at least in part, computerized method. The method being, at least in part, computerized meaning that it is performed at least in part with/using/by the at least one device that is suitable and/or adapted for performing at least parts of the inventive method and/or embodiments thereof.

With reference to the above, the inventive method, and embodiments thereof, as described above, may be referred to as an, at least in part, automated method. The method being, at least in part, automated meaning that it is performed with/using/by the at least one device that is suitable and/or adapted for performing at least parts of the inventive method and/or embodiments thereof.

The present invention is not limited to the embodiments of the invention described above, but relates to and comprises all embodiments within the scope of the enclosed independent claims.

The invention claimed is:

1. A method for control of an activation of at least one fluid sensitive sensor of an exhaust treatment system arranged for treating an exhaust stream from an engine, wherein said method comprises:

determining at least one exhaust temperature and at least one exhaust mass flow for said exhaust stream;

determining if there is liquid fluid present in the exhaust stream at said at least one fluid sensitive sensor, respectively, based on:

at least one elimination time function, wherein said at least one elimination time function is based on said at least one determined exhaust temperature and said at least one determined exhaust mass flow; and a corresponding length of at least one time period needed to eliminate a predetermined amount of liquid fluid from said exhaust stream; and controlling the activation of said at least one fluid sensitive sensor based on said determining if there is liquid fluid present in said exhaust treatment system at said at least one fluid sensitive sensor.

2. The method as claimed in claim 1, wherein, if it is determined that said exhaust stream is free of the liquid fluid at said at least one fluid sensitive sensor, said at least one fluid sensitive sensor is activated by said control.

3. The method as claimed in claim 1, wherein said at least one elimination time function is normalized relative to a shortest time period $t_{free_of_liquid_min}$ needed to eliminate said predetermined amount of liquid fluid from said exhaust stream.

4. The method as claimed in claim 1, wherein said at least one elimination time function is based at least on an exhaust stream convection.

5. The method as claimed in claim 1, wherein said at least one elimination time function is based at least on a friction between said fluid and a rest of said exhaust stream.

6. The method as claimed in claim 1, wherein said at least one elimination time function is determined by:

inserting said predetermined amount of liquid fluid into said exhaust treatment system;

measuring at least one exhaust temperature related to said at least one fluid sensitive sensor, respectively, until said predetermined amount of liquid fluid has been essentially eliminated; and measuring at least one exhaust mass flow related to said at least one fluid sensitive sensor, respectively, until said predetermined amount of liquid fluid has been essentially eliminated.

7. The method as claimed in claim 6, wherein said predetermined amount of liquid fluid is determined as having been essentially eliminated by use of at least one temperature sensor.

8. The method as claimed in claim 1, wherein said at least one fluid sensitive sensor includes at least one of:

at least one self-heating sensor;

at least one nitrogen oxides sensor;

at least one air fuel ratio sensor;

at least one oxygen sensor;

at least one mass flow sensor; and/or at least one particle matter sensor.

9. The method as claimed in claim 1, wherein said determining if there is liquid fluid present in said exhaust stream, comprises:

determining a sum of values for said at least one elimination time function until a first point in time $t_1$, respectively; and determining that said exhaust stream is free of liquid fluid at said first point in time if said at least one sum of values is greater than the corresponding length of at least one time period needed to eliminate said predetermined amount of liquid fluid from said exhaust stream.

10. The method as claimed in claim 1, wherein said at least one time period needed to eliminate said predetermined amount of liquid fluid from said exhaust stream depends on at least one of:

a geometrical design of said exhaust treatment system;

a surface of at least one inner wall of said exhaust treatment system; and/or a thermal conductibility of at least one inner wall of said exhaust treatment system.

11. The method as claimed in claim 1, wherein said predetermined amount of liquid fluid depends on at least one of:

a usage of a vehicle including said exhaust treatment system;

at least one physical feature of said exhaust treatment system; and/or at least one ambient condition outside a vehicle including said exhaust treatment system.

12. The method as claimed in claim 1, wherein said at least one time period needed to eliminate said predetermined amount of liquid fluid is in an interval of at least one of: 2-8 minutes, or in an interval of 4-6 minutes, or 5 minutes.

13. The method as claimed in claim 1, wherein controlling the activation of said at least one fluid sensitive sensor comprises controlling an activation of said at least one fluid sensitive sensor after the corresponding length of at least one time period has elapsed indicating that the predetermined amount of liquid fluid has been eliminated in said exhaust treatment system at said at least one fluid sensitive sensor.

14. A computer program product comprising computer program code stored on a non-transitory computer-readable medium, said computer program product used for control of an activation of at least one fluid sensitive sensor of an exhaust treatment system arranged for treating an exhaust stream from an engine, said computer program code comprising computer instructions to cause one or more control devices to perform the following operations:

determining at least one exhaust temperature and at least one exhaust mass flow for said exhaust stream;

determining if there is liquid fluid present in the exhaust stream at said at least one fluid sensitive sensor, respectively, based on:

at least one elimination time function, wherein said at least one elimination time function is based on said at least one determined exhaust temperature and said at least one determined exhaust mass flow; and a corresponding length of at least one time period needed to eliminate a predetermined amount of liquid fluid from said exhaust stream; and controlling the activation of said at least one fluid sensitive sensor based on said determining if there is liquid fluid present in said exhaust treatment system at said at least one fluid sensitive sensor.

15. A system arranged for control of an activation of at least one fluid sensitive sensor of an exhaust treatment system arranged for treating an exhaust stream from an engine, said system comprises:

first means arranged for determining at least one exhaust temperature and at least one exhaust mass flow for said exhaust stream;

second means arranged for determining if there is liquid fluid present in the exhaust stream at said at least one fluid sensitive sensor, respectively, based on:

at least one elimination time function, wherein said at least one elimination time function is based on said at least one determined exhaust temperature and said at least one determined exhaust mass flow; and a corresponding length of at least one time period needed to eliminate a predetermined amount of liquid fluid from said exhaust stream; and means for controlling the activation of said at least one fluid sensitive sensor based on said determining if there is liquid fluid present in said exhaust treatment system at said at least one fluid sensitive sensor.

* * * * *